US006776308B1

(12) United States Patent
Davis et al.

(10) Patent No.: US 6,776,308 B1
(45) Date of Patent: Aug. 17, 2004

(54) APPARATUS WITH MULTIPLE PAINT INTAKES

(76) Inventors: Dave D. Davis, P.O. Box 788, Flora Vista, NM (US) 87415; M. Shane Davis, P.O. Box 788, Flora Vista, NM (US) 87415

( * ) Notice: Subject to any disclaimer, the term of this patent is extended or adjusted under 35 U.S.C. 154(b) by 247 days.

(21) Appl. No.: 10/170,722

(22) Filed: Jun. 12, 2002

(51) Int. Cl.[7] ..... B67D 5/58

(52) U.S. Cl. ..... 222/189.1; 222/136; 222/382; 222/464.1; 137/561 R; 137/266; 137/590

(58) Field of Search ..... 222/136, 189.1, 222/321.4, 376, 382, 464.1, 464.2; 239/302, 303, 575; 137/561 R, 266, 590

(56) References Cited

U.S. PATENT DOCUMENTS

| | | | | |
|---|---|---|---|---|
| 2,620,114 A | * | 12/1952 | Graham | 137/579 |
| 2,796,205 A | * | 6/1957 | Kuzma | 222/464.1 |
| 2,935,057 A | * | 5/1960 | Perlewitz | 123/73 A |
| 3,519,168 A | * | 7/1970 | Halbert | 222/132 |
| 3,940,065 A | | 2/1976 | Ware et al. | |
| 4,027,785 A | | 6/1977 | Edstrom et al. | |
| 4,067,500 A | | 1/1978 | Stevenson | |
| 4,235,377 A | | 11/1980 | Davis et al. | |
| D271,613 S | | 11/1983 | Watkins | |
| 4,576,553 A | | 3/1986 | Winston et al. | |
| D310,117 S | | 8/1990 | Mariol | |
| 5,044,557 A | | 9/1991 | Smith | |
| 5,086,978 A | * | 2/1992 | Fertig | 239/305 |
| 5,129,551 A | | 7/1992 | Gott | |
| 5,139,170 A | | 8/1992 | Bullock | |
| 5,398,846 A | | 3/1995 | Corba et al. | |
| 5,494,199 A | * | 2/1996 | Anderson et al. | 222/464.1 |
| 6,227,412 B1 | * | 5/2001 | Sweeton | 222/189.1 |

FOREIGN PATENT DOCUMENTS

| | | |
|---|---|---|
| EP | 0 461 277 A1 | 6/1990 |
| EP | 0 750 945 A1 | 6/1996 |
| WO | WO 94/21554 | 9/1994 |
| WO | WO 95/05998 | 3/1995 |

* cited by examiner

*Primary Examiner*—Gregory L. Huson
*Assistant Examiner*—Patrick Buechner
(74) *Attorney, Agent, or Firm*—Leonard & Proehl, L.L.C.

(57) ABSTRACT

A apparatus with multiple paint intakes for providing a painting professional with the ability to draw paint from more than one container before having to reposition the spray painting equipment to draw from additional containers. The apparatus with multiple paint intakes includes a housing defining an interior chamber and a plurality of elongate support legs mounted on the housing for supporting the housing in an elevated condition above a surface. Each of the support legs has opposite ends, and each of the support legs has a passage formed therein extending between the opposite ends of the support leg and being in fluid communication with the interior chamber of the housing for permitting fluid to be drawn through each of the plurality of support legs and into the interior chamber.

17 Claims, 5 Drawing Sheets

APPARATUS WITH MULTIPLE PAINT INTAKES

BACKGROUND OF THE INVENTION

1. Field of the Invention

The present invention relates to paint intake devices and more particularly pertains to a new apparatus with multiple paint intakes for providing a painting professional with the ability to draw paint from more than one container before having to reposition the spray painting equipment to draw from additional containers.

2. Description of the Prior Art

Painters typically obtain paint in a can or bucket container that has a lid or a smaller cap that is removed to access the paint in the interior of the container. While consumers typically purchase paint in one gallon cans, professional painters involved in large painting projects often obtain paint in larger five gallon buckets. Over the course of a project such as the painting of the interior of a residential house, the paint from several of the five gallon buckets may be applied even in a single day. If a primer coat is to be applied initially, the total amount of paint to be applied can double or even triple. Thus, over the course of a single day on a single painting project, the painting professional may switch between several of the five gallon buckets for a supply of paint.

Often the painting professional will use a paint spraying apparatus to apply the paint, and this is especially true for large projects. The paint spraying apparatus often includes an intake structure for drawing paint directly from the paint container. A typical paint intake structure is designed to cantilever over the top of a paint bucket with a flexible tube extending downwardly for positioning in the paint container. As each paint container is emptied, the painting professional must discontinue painting and move the paint intake structure from the emptied container to a container with more paint. The painting professional may also have to perform additional activities at each of these changeover times, including removal of protective gear. This process may be repeated a number of times during a day, especially at high paint application rates. In fact, at one typical paint application rate, a five gallon container may be emptied in a period of as little as 15 minutes.

If only for productivity reasons, it is thus desirable to minimize the number of times that the paint intake structure must be moved from paint container to paint container, and the resulting interruptions in the painting process that are caused by having to change between containers. One approach would be to increase the size of the paint containers, but the paint-filled five gallon container is likely the maximum container size that can be regularly lifted and moved by a painting professional without increasing the risk of physical injury. The solution to this problem has there been elusive.

The apparatus with multiple paint intakes according to the present invention substantially departs from the conventional concepts and designs of the prior art, and in so doing provides an apparatus primarily developed for the purpose of providing a painting professional with the ability to draw paint from more than one container before having to reposition the spray painting equipment to draw from additional containers.

SUMMARY OF THE INVENTION

In view of the foregoing disadvantages inherent in the known types of paint intake devices now present in the prior art, the present invention provides a new apparatus with multiple paint intakes construction wherein the same can be utilized for providing a painting professional with the ability to draw paint from more than one container before having to reposition the spray painting equipment to draw from additional containers.

To attain this, the present invention generally comprises a housing defining an interior chamber and a plurality of elongate support legs mounted on the housing for supporting the housing in an elevated condition above a surface. Each of the support legs has opposite ends, and each of the support legs has a passage formed therein extending between the opposite ends of the support leg and being in fluid communication with the interior chamber of the housing for permitting fluid to be drawn through each of the plurality of support legs and into the interior chamber.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

One significant advantage of the present invention is the ability to draw a fluid such as paint from a number of containers to thereby reduce the number of times that the apparatus must be removed from an emptied container and replaced on a container with paint.

Another advantage of the invention is the capability to draw fluid simultaneously from multiple containers to provide a mixing of the paint from each container to obtain a more uniform and consistent paint color and minimize any paint shade variations that may occur from container to container.

The advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
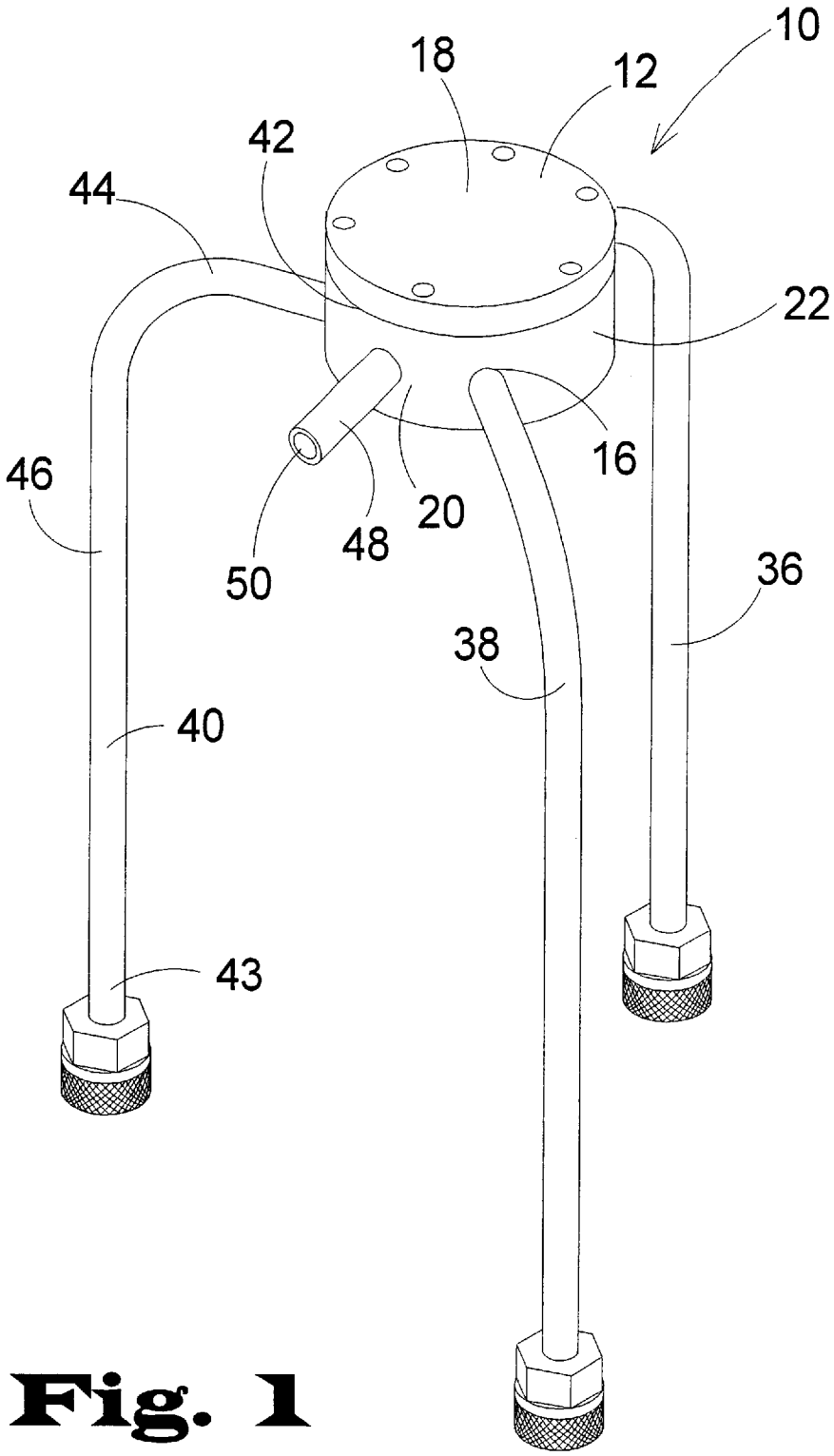
FIG. 1 is a schematic perspective view of a new apparatus with multiple paint intakes according to the present invention.
Figure 2:
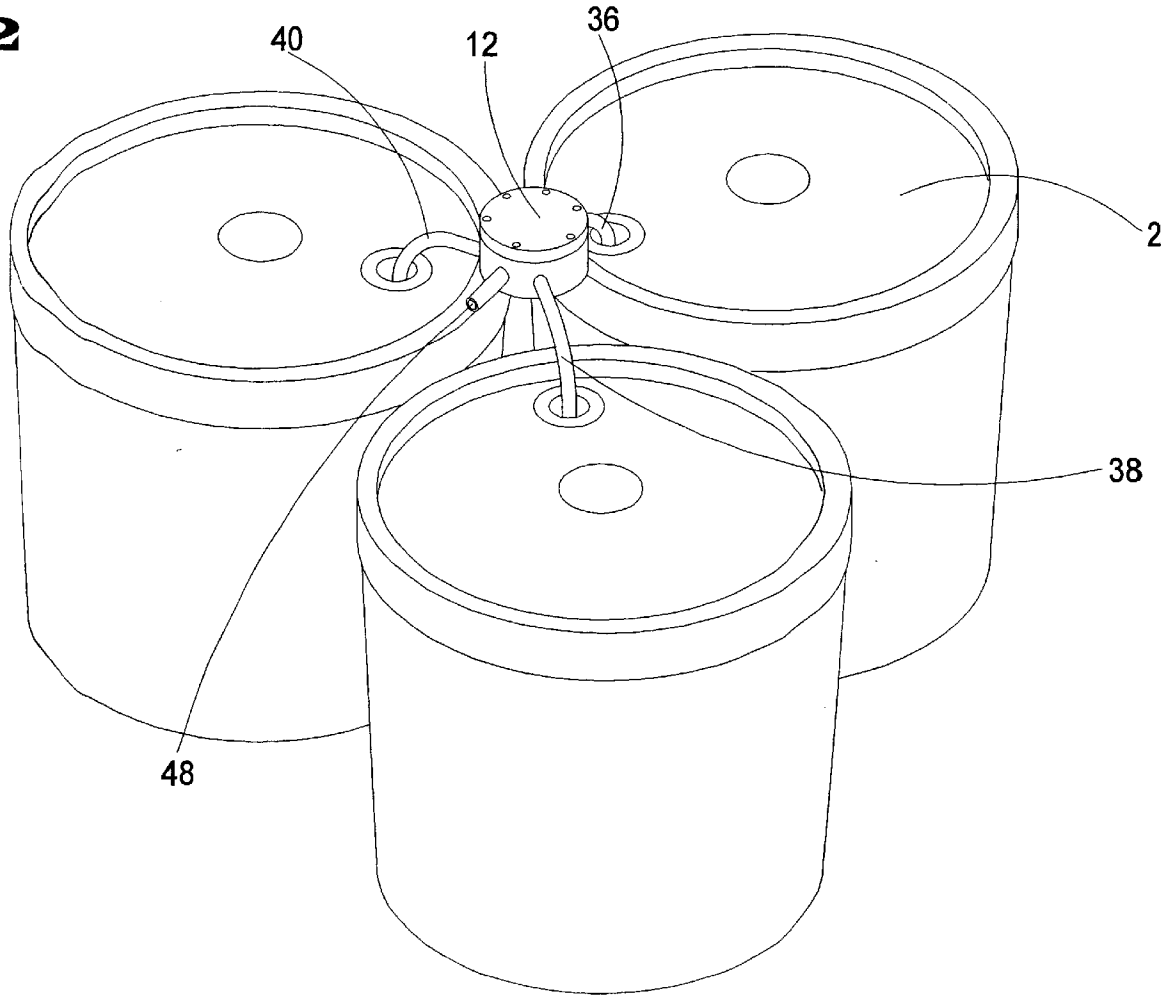
FIG. 2 is a schematic perspective view of the present invention shown in use on a plurality of paint containers for drawing paint from each of the containers.
Figure 3:
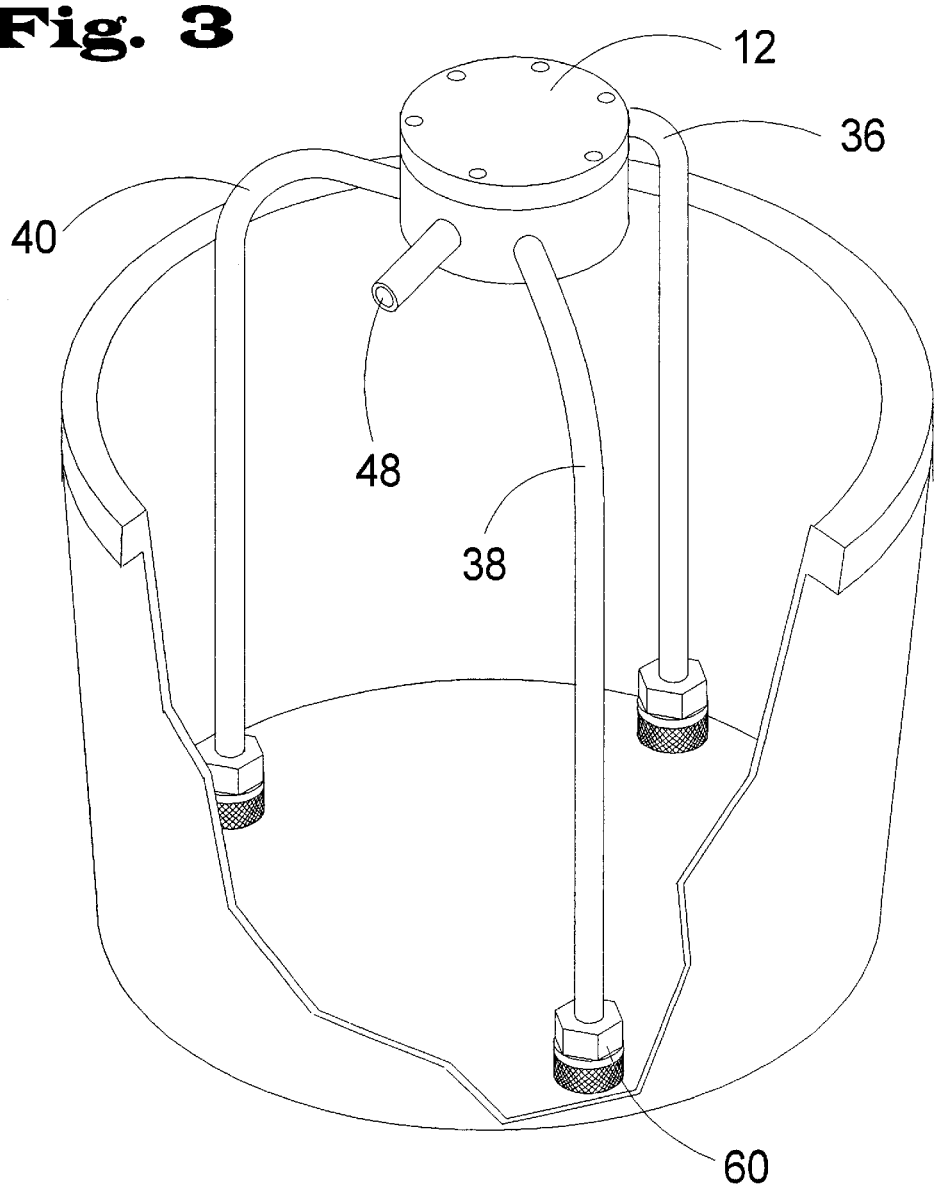
FIG. 3 is a schematic top view of the present invention shown positioned in the interior of a single paint container for drawing paint from a single paint container.
Figure 4:
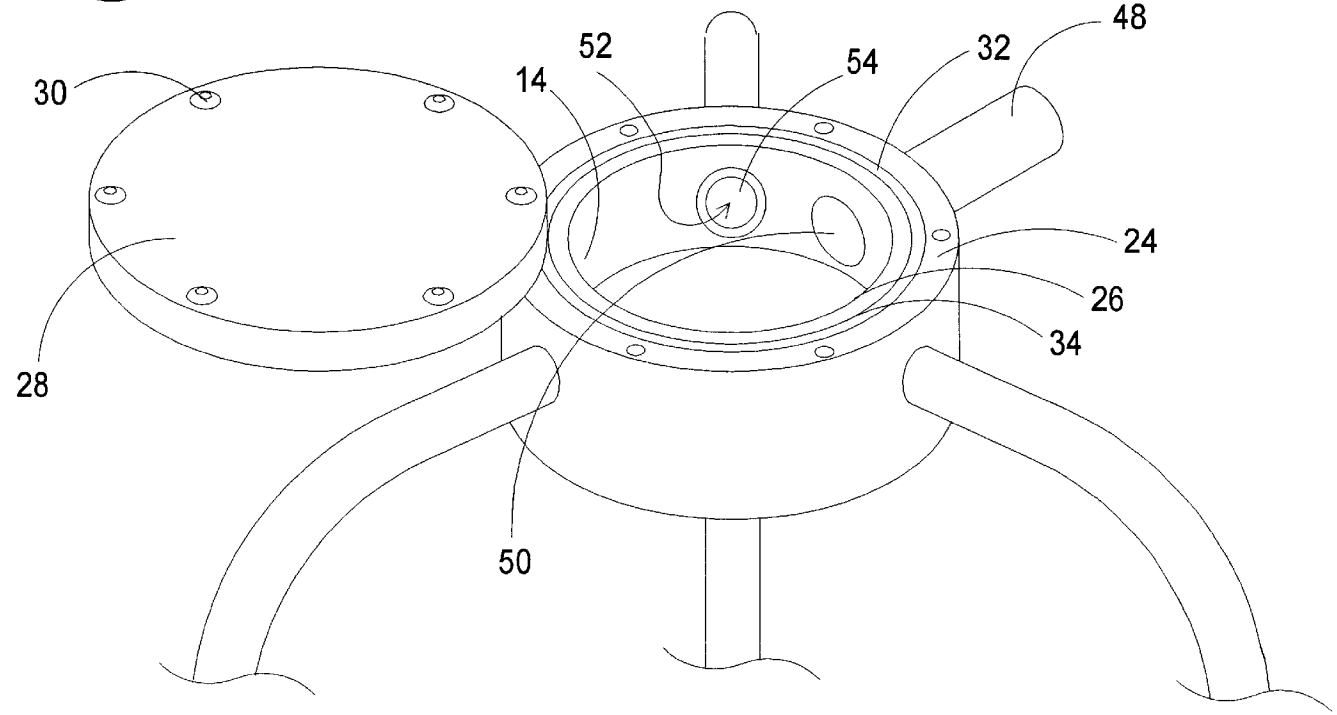
FIG. 4 is a schematic top perspective view of the present invention with the cap portion of the housing is partially rotated from its operating position over recess of the cup portion.
Figure 5:
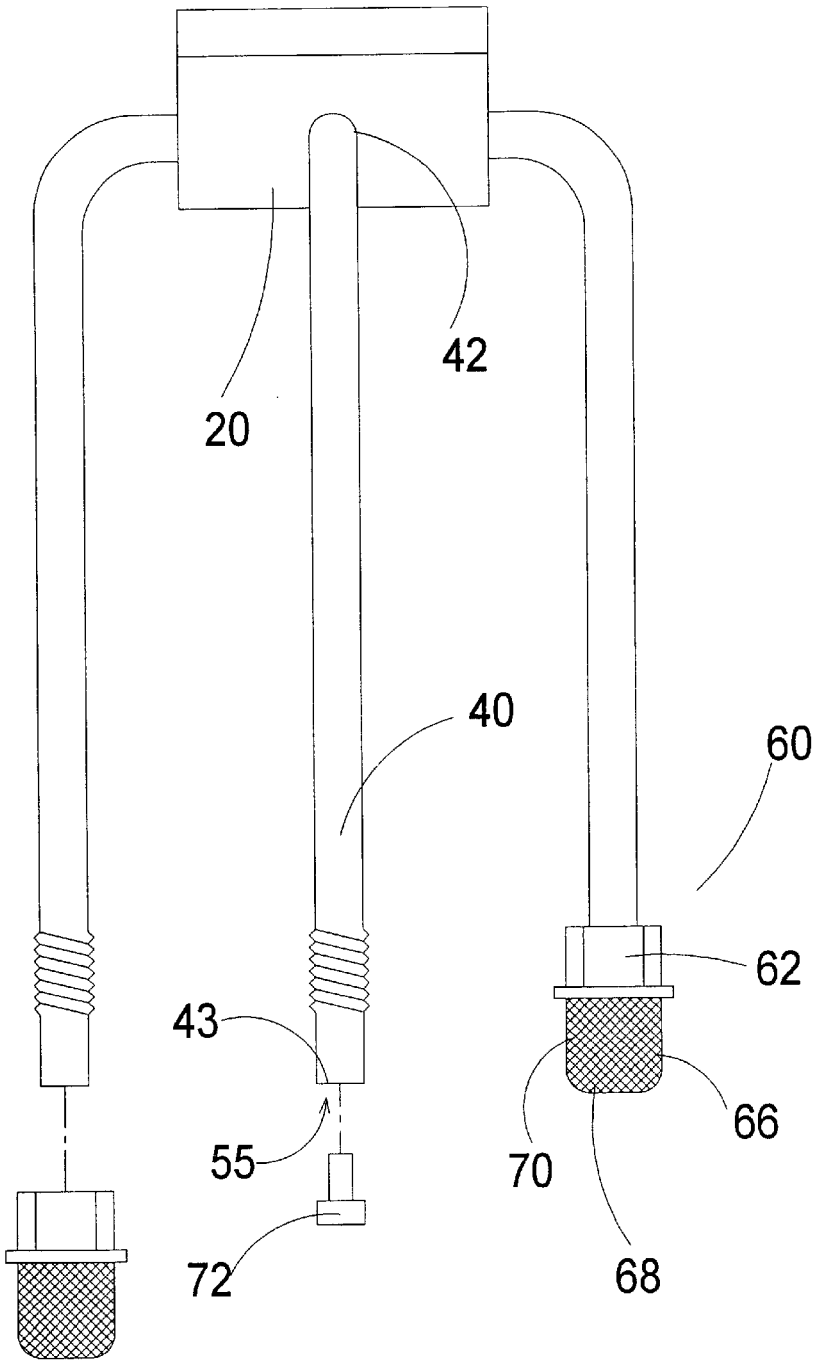
FIG. 5 is a schematic side view of the apparatus showing one filter assembly on a support leg, one assembly removed to show detail of the leg, and one assembly replaced by a plug.

With reference now to the drawings, and in particular to FIGS. 1 through 5 thereof, a new apparatus with multiple paint intakes embodying the principles and concepts of the present invention and generally designated by the reference numeral 10 will be described.

As best illustrated in FIGS. 1 through 5, the apparatus with multiple paint intakes 10 generally comprises a housing 12 and a plurality of support legs 36, 38, 40. It should be understood that, although the following description describes the features of the invention in terms of its usage with paint and other protective coatings, the invention is similarly functional with a variety of fluids and thus may find suitable uses with a variety of fluids other than paints and coatings.

The housing 12 of the fluid suctioning apparatus 10 of the invention defines an interior chamber 14. The housing 12 has a plurality of apertures 16 that are formed in the housing and are in fluid communication with the interior chamber 14. The housing 12 may have a top 18 and a bottom 20 and a side 22 that extends between the top and bottom. Each of the apertures may be located on the side 22 of the housing 12, and the purpose of the apertures will be described in greater detail below. Preferably, the surfaces of the housing may be relatively smooth to facilitate cleaning of the housing surfaces of fluids such as paint after use of the apparatus.

In one embodiment of the invention, the housing 12 comprises a cup portion 24 and a cap portion 28. The cup portion 24 may have a recess 26 that is formed therein, and which defines a portion of the interior chamber 14. The plurality of apertures 16 may be located in the cup portion 4 and may be in fluid communication with the recess 26 to permit fluid movement between the apertures 16 and the recess 26. The cap portion 28 may be removably mounted on the cup portion 24 to cover and thus act as a lid for the recess 26 in the cup portion. The cap portion 28 may be removably fastened to the cup portion 24 by fasteners 30 such that the cap portion may be removed from the cup portion to access and cleaning the interior chamber 14 of the housing. In one preferred embodiment of the invention, the housing 12 includes a gasket ring 32 for blocking fluid movement between the cap portion 24 and the cup portion 28 to minimize fluid leakage out of the interior chamber and/or air movement into the interior chamber through the joint between the cap and cup portions. The gasket ring 32 may be partially located in an annular channel 34 that is formed in a top of the cup portion 24 about the recess 26.

The plurality of elongate support legs 36, 38, 40 of the invention are mounted on the housing 12 for supporting the housing in an elevated condition above a surface on which the support legs are rested. Each of the support legs 36, 38, 40 may be elongate and have opposite first 42 and second 43 ends. The first ends 42 of each of the support legs are mounted on the housing 12 and the second ends 43 of each of the support legs are restable on a surface such that the support legs extend between the elevated housing and the surface. Each of the second ends 43 of the plurality of support legs may terminate in a substantially common plane for resting stably on the surface.

In one preferred embodiment of the invention, each of the support legs 36, 38, 40 has a spacing portion 44 and a depending portion 46, with the spacing portion spacing or separating the depending portion of each support leg from the housing 12, and the other support legs, such that the depending portions each descend at a location that is spaced radially outward from the housing. The spacing portions 44 of each of the support legs may extend radially outward from the housing 12 and may all lie in a substantially common plane, and the common plane may be substantially parallel to top and bottom surfaces of the housing 12. Each of the spacing portions 44 may extend from the housing 12 at an angle of approximately 120 degrees with respect to each of the other spacing portions. The depending portions 46 of each of the support legs may extend substantially perpendicularly to the spacing portion 44 of the respective support leg, and the depending portions of the plurality of support legs may all extend substantially perpendicularly to the substantially common plane of the spacing portions.

An outlet conduit 48 may be provided for connecting to the intake of a paint pumping apparatus, and a transfer conduit (not shown) may connect the outlet conduit to the paint pumping apparatus. The outlet conduit 48 may be mounted on the housing 12, and may have a lumen 50 that is in fluid communication with the interior chamber 14 of the housing such that fluid in the interior chamber of the housing may drawn out of the interior chamber through the lumen 50 of the outlet conduit. Optionally, the paint pumping apparatus may be integrated with or mounted on the housing 14 of the apparatus 10 of the invention, thus removing the need for the outlet conduit or any exterior conduit between the housing and the pumping apparatus. In such an embodiment, the support legs may thus support the housing 14 and the paint pumping apparatus.

It is contemplated that the support legs 36, 38, 40 be formed of a relatively rigid material of sufficient strength to support the housing 14 in an elevated condition, although it may be possible to form the support legs from a less rigid and freely flexible material that may not independently support the housing. Such an option is considered less preferable because the housing is not supported by freely flexible legs that lack appreciable rigidity, and another source of support of the housing typically needs to be provided for the housing.

Significantly, each of the support legs 36, 38, 40 also functions as a fluid intake for permitting fluid to be sucked or pulled through the support leg into the interior chamber 14. Each of the support legs may have a passage 52 formed therein that extending between the opposite ends 42, 43 of the support leg, and the passage of each of the support legs may be in fluid communication with the interior chamber 14 of the housing 12 such that fluid may be drawn through the passages of the support legs into the interior chamber. Each of the support legs may be tubular, and the passage 52 of each of the support legs 26, 28, 40 may terminate in a first opening 54 that is located near the first end 42 of the support leg and a second opening 55 that is located near the second end 43 of the support leg such that fluid may be drawn through the second opening, the passage, and the first opening of the support leg. In one embodiment of the invention, the second opening 55 of each of the support legs is located at the second end 43 of the respective support leg such that submersion of the second end of the support leg in a fluid places the passage 52 in fluid communication with the fluid.

In the most preferred embodiment of the invention, the plurality of support legs comprises three support legs such that the support legs are capable of freestanding supporting the housing above a surface without requiring external support. The plurality of support legs may include only two support legs, but this configuration is not as highly preferred as the apparatus would most likely have to be leaned against an external support to remain upright. In one illustrative embodiment of the invention that is especially useful for use with five gallon paint containers, the distance between the support legs is approximately 7.5 inches (approximately 19 cm), although spacings of approximately 6 inches (approximately 15 cm) to approximately 9 inches (approximately 23 cm) may be useful. Further, a height of the support legs that elevates the bottom of the housing 12 approximately 15 inches (approximately 38 cm) above a surface on which the support legs are resting is highly suitable. Heights slightly less than this may be used but may have difficulty reaching the bottom of the paint container, and heights larger than this may also be used but may tend to make the apparatus more prone to be knocked over due to an increasingly top heavy character.

One preferred option of the invention is a filter assembly 60, with one filter assembly being mounted on each of the support legs 36, 38, 40 at the second end thereof. The filter assembly 60 of each support leg may cover the second opening 55 so that the filter assembly filters fluid before it enters the second opening and the passage 52. In one embodiment of the invention, each of the filter assemblies includes a collar 62 and a screen 66. The collar 62 may be removably mountable on the second end 43 of the support legs, and the collar may have a hole 64 that slidably receives the second end of the support leg such that the second end is positioned in the interior of the filter assembly. Optionally, an edge extending about the hole 64 may have interior threads formed thereon, and a portion of an exterior surface of the support legs may have an exterior thread formed thereon. The collar 62 may have a hexagonal perimeter shape for permitting a wrench to engage portions of the perimeter of the collar. The screen 66 may be mounted on the collar 62 about the hole 64 in the collar such that fluid must pass through the screen before entering the second opening 43 in the support leg. The screen 66 may have a bottom extent 68 and a perimeter extent 70 extending away from the bottom extent. When the support legs are rested on the surface, the bottom extent 68 of the filter assembly is placed in abutment with the surface, and the filter assembly may space the second end 43 of the support leg from the surface on which the apparatus 10 is resting, such as the bottom wall of a container.

Optionally, a removable plug 72 may be provided for permitting selective plugging of the second opening 55 of one of the support legs so that when not all of the support legs are needed to draw fluid from a container, one or more of the second openings of the support legs may be blocked so that air is not drawn through the support leg if the second end is not immersed in the fluid. For example, if the apparatus is provided with three support legs and it is desired to only draw from two containers, the second openings of the support legs not placed in containers may be plugged and the plugged support leg left to rest outside a container. It should be appreciated that in the most preferred embodiments of the invention, all of the support legs may be placed inside the same container having a sufficiently large mouth (such as a bucket with the lid removed) for drawings fluid from the container, or during times of cleaning to draw a solvent from the single container through the apparatus.

In one embodiment of the invention, the diameter of the lumen 50 of the outlet conduit 48 is approximately three times as large as the diameter of each of the passages 52 of the support legs 26, 28 40. The depending portions 46 of the support legs may have a length such that the spacing portions and the housing do not rest on the top of the containers, and reach to within approximately one-half inch of the bottom wall of the container.

In use, one or more painting containers may be placed in the appropriate location adjacent to the paint pumping apparatus. If paint is to be drawn from only one container, all of the support legs may be inserted in the container at the same time (such as when the lid has been removed from the container), or one of the support legs may be inserted into the container while the second openings of the other support legs are plugged (such as when only the spout has been removed from the lid of the container). If paint is to be drawn from more than one container, one or more of the support legs may be inserted in each of the containers. In the case when three containers are to be drawn from, the spout openings of each of the containers may be positioned as close as possible to each other such that the containers and the spout openings form a triangular configuration, and one of the support legs is inserted into each of the spout openings and immersed in the paint in each of the containers. After use, the support leg or legs may be immersed in one or more containers containing a solvent to cleaning the apparatus, and additional steps may be taken to clean the apparatus such as removing the cap portion 28 from the cup portion 24.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A fluid suctioning apparatus comprising:

a housing defining an interior chamber; and a plurality of elongate support legs mounted on the housing for supporting the housing in an elevated condition above a surface, each of the support legs having opposite ends;

wherein each of the support legs has a passage formed therein extending between the opposite ends of the support leg and being in fluid communication with the interior chamber of the housing for permitting fluid to be drawn through each of the plurality of support legs and into the interior chamber.

2. The apparatus of claim 1 wherein the passage of each of the support leg terminating in a first opening located near the first end of the support leg and a second opening located near the second end of the support leg such that fluid is drawable through the second opening, the passage, and the first opening of the support leg.

3. The apparatus of claim 2 wherein the second opening of each of the support legs is located at the second end of the respective support leg such that submersion of the second end of the support leg in a fluid places the passage in fluid communication with the fluid.

4. The apparatus of claim 1 wherein the plurality of support legs comprises three support legs such that the support legs are capable of supporting the housing above a surface without requiring external support.

5. The apparatus of claim 1 additionally comprising a filter assembly mounted on each of the support legs at a second end thereof for filtering fluid before entering the passage of the support leg.

6. The apparatus of claim 5 wherein the filter assembly spaces the second end of the support leg from the surface.

7. The apparatus of claim 2 additionally comprising a removable plug for permitting selective plugging of the second opening of one of the support legs.

8. The apparatus of claim 1 wherein the housing has a plurality of apertures in fluid communication with the interior chamber, each of the support legs being attached to one of plurality of apertures.

9. The apparatus of claim 1 wherein the housing comprises:

a cup portion having a recess formed therein for defining a portion of the interior chamber; and a cap portion removably mounted on the cup portion to cover the recess in the cup portion.

10. The apparatus of claim 9 wherein the housing includes a gasket ring for blocking fluid movement between the cap portion and the cup portion, the gasket ring being partially located in an annular channel formed in a top of the cup portion about the recess.

11. The apparatus of claim 1 wherein each of the support legs has a spacing portion and a depending portion, the spacing portion extending radially outward from the housing.

12. The apparatus of claim 11 wherein the depending portion of each support leg extends substantially perpendicularly to the spacing portion of the support leg.

13. The apparatus of claim 11 wherein the spacing portions of the plurality of support legs all lie in a substantially common plane.

14. The apparatus of claim 1 additionally comprising an outlet conduit mounted on the housing and having a lumen being in fluid communication with the interior chamber of the housing such that fluid in the interior chamber of the housing is drawable from the interior chamber through the lumen of the outlet conduit.

15. A fluid suctioning apparatus comprising:

a housing defining an interior chamber, the housing having a plurality of apertures in fluid communication with the interior chamber, the housing having a top and a bottom and a side extending between the top and bottom, each of the apertures being located on the side of the housing;

a plurality of elongate support legs mounted on the housing for supporting the housing in an elevated condition above a surface, each of the support legs having opposite ends, a first one of the opposite ends of each of the support legs being mounted on the housing, a second one of the opposite ends of each of the support legs being restable on a surface, each of the second ends of the plurality of support legs lying in a substantially common plane for resting stably on the surface, each of the support legs having a spacing portion and a depending portion, the spacing portion extending radially outward from the housing and the depending portion extending substantially perpendicularly to the spacing portion, the spacing portions of the plurality of support legs all lying in a substantially common plane;

an outlet conduit mounted on the housing and having a lumen being in fluid communication with the interior chamber of the housing such that fluid in the interior chamber of the housing is drawable from the interior chamber through the lumen of the outlet conduit;

wherein each of the support legs has a passage formed therein extending between the opposite ends of the support leg, the passage of each of the support legs being in fluid communication with the interior chamber of the housing such that fluid is drawable through the passages of the support legs into the interior chamber of the housing, the passage of each of the support leg terminating in a first opening located near the first end of the support leg and a second opening located near the second end of the support leg such that fluid is drawable through the second opening, the passage, and the first opening of the support leg, wherein the second opening of each of the support legs is located at the second end of the respective support leg such that submersion of the second end of the support leg in a fluid places the passage in fluid communication with the fluid; and wherein the plurality of support legs comprises three support legs such that the support legs are capable of supporting the housing above a surface without requiring external support.

16. The apparatus of claim 15 additionally comprising a filter assembly mounted on each of the support legs at the second thereof and covering the second opening for filtering fluid before entering the second opening, each of the filter assemblies comprising:

a collar removably mountable on the second end of the support legs, the collar having a hole slidably receiving the second end of the support leg, an edge about the hole having interior threads and a portion of an exterior surface of the support legs having an exterior thread formed thereon, the collar having a hexagonal perimeter shape for permitting a wrench to engage portions of the perimeter of the collar; and a screen mounted on the collar about the hole in the collar such that fluid must pass through the screen before entering the second opening in the support leg, the screen having a bottom extent and a perimeter extent extending away from the bottom extent.

17. The apparatus of claim 15 additionally comprising a removable plug for permitting selective plugging of the second opening of one of the support leg.

* * * * *